United States Patent [19]

Gilb et al.

[11] Patent Number: 4,924,648

[45] Date of Patent: May 15, 1990

[54] STANDOFF TIMBER BASE CONNECTION

[75] Inventors: Tyrell T. Gilb, Berkeley; Alfred D. Commins, Danville, both of Calif.

[73] Assignee: Simpson Strong-Tie Company, Inc., San Leandro, Calif.

[21] Appl. No.: 321,186

[22] Filed: Mar. 9, 1989

[51] Int. Cl.[5] ..... E04H 12/22

[52] U.S. Cl. ..... 52/295; 52/297

[58] Field of Search ..... 52/712, 713, 714, 294, 52/295, 296, 297, 370

[56] References Cited

U.S. PATENT DOCUMENTS

| | | | |
|---|---|---|---|
| D. 215,727 | 10/1969 | Gilb | D28/1 |
| D. 254,476 | 3/1980 | Gilb | D8/354 |
| D. 260,964 | 9/1981 | Gilb | D8/373 |
| 589,079 | 8/1897 | Glazier . | |
| 887,217 | 5/1908 | Oliphant . | |
| 953,060 | 3/1910 | Ross . | |
| 1,544,863 | 7/1925 | Ross . | |
| 2,182,579 | 12/1939 | Bolton et al. . | |
| 2,909,816 | 10/1959 | Wood . | |
| 3,750,360 | 8/1973 | Kingston | 52/295 |
| 4,096,677 | 6/1978 | Gilb | 52/297 |
| 4,199,908 | 4/1980 | Teeters | 52/295 |

OTHER PUBLICATIONS

Simpson Strong-Tie Company Catalog, pp. 12–13, copyright 1988.

*Primary Examiner*—John E. Murtagh

*Attorney, Agent, or Firm*—James R. Cypher

[57] ABSTRACT

A timber and concrete connection which includes a steel connector formed with stirrup members embedded in the concrete and which extend above the concrete for fastening to the timber member. The timber member rests on a standoff member which holds the base of the timber member a specified distance above the concrete; usually one inch. The standoff member is constructed from a single sheet of metal and in one form of the invention is releasably connected to the stirrup members. In another form of the invention, the standoff member is restrained from horizontal movement in all directions by the stirrup members, and in still another form of the invention the standoff member may simply be placed between the stirrup members and either welded to the stirrup members or not.

15 Claims, 10 Drawing Sheets

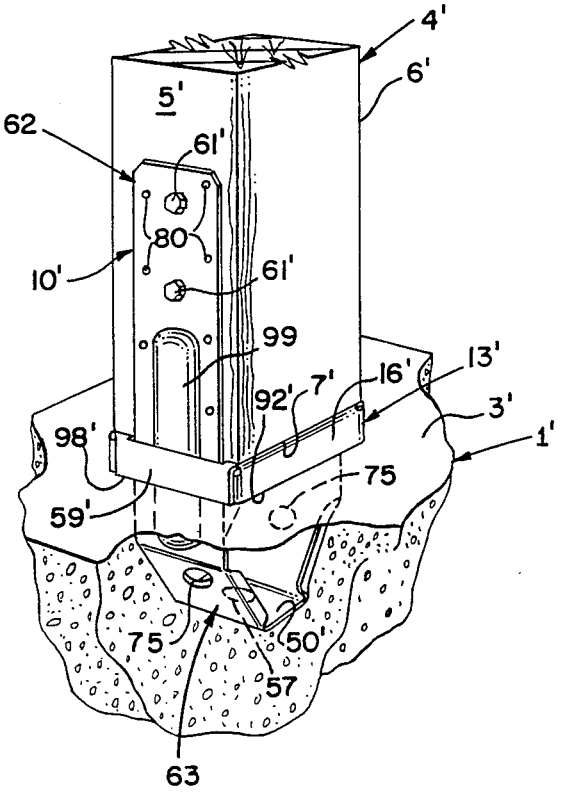
FIG. 10
FIG. 11
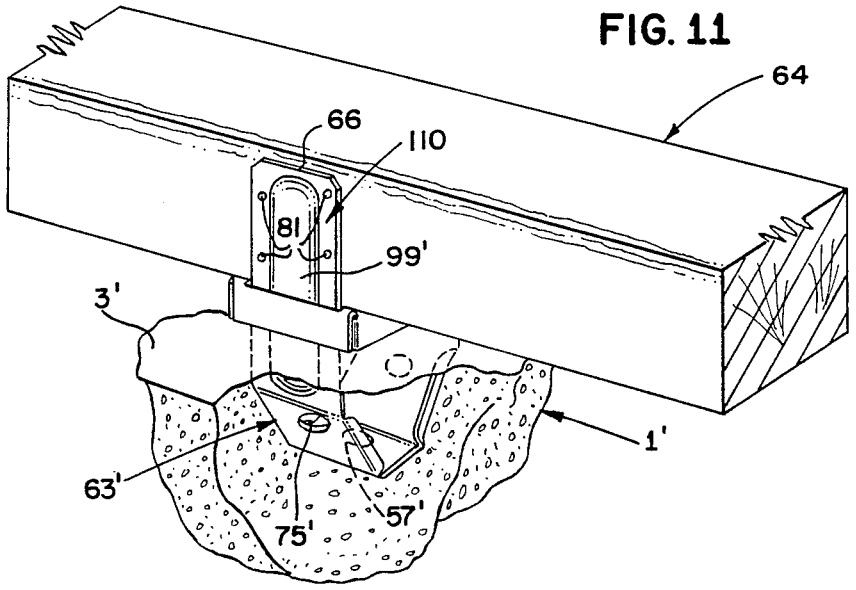

STANDOFF TIMBER BASE CONNECTION

BACKGROUND

This invention relates to a standoff connection in which a metal connector joins a concrete base and a timber structural member.

It has long been known and increasingly recognized by building codes to raise all wood structural members above concrete surfaces which are subject to wetting. Many building codes require a 1" standoff.

Because of the high uplift load requirements, most connector manufacturers were only able to meet the various requirements by providing an expensive connector constructed from steel plates, welded and painted.

Present construction practices require a connector that can be set on a sub-base, the wood timber installed, and the building erected before making the final pour of the concrete floor. There is presently no connector in the prior art which can be used for pre-pour construction and the standoff member adjusted vertically with respect to the stirrups if the elevation of the stirrups were not originally set to the correct elevation.

Present attempts to provide separate standoff members have been unacceptable since there is no horizontal restraint between the standoff member and the stirrup members.

Finally, there is no present connector which is suitable for providing the standoff code requirement in a sheet metal connector which can be used to directly support beam members in the construction of ground level patio decks.

SUMMARY OF THE INVENTION

The gist of the present invention is the use of a specially constructed sheet metal standoff plate which may be releasably connected to a pair of stirrup members and thereby provide vertical adjustment after the stirrups have been anchored in their final position.

Another object of the present invention is to provide a metal connector with sufficient columnar strength to permit anchoring of the connector, attachment of the wood timber to the connector and the partial construction of the building prior to the final pour of the concrete base or floor.

A further object of the present invention is to provide a metal connector in which vertical adjustment of the standoff member can be effected without relative horizontal movement between the standoff plate and the stirrups.

Still another object is to provide a metal connector for connecting timber deck support beam members directly to the concrete foundation.

BRIEF DESCRIPTION OF THE DRAWINGS

FIG. 10 is a perspective view of the connector illustrated in FIG. 9 with a timber post connected thereto and embedded in concrete. Portions of the concrete have been cut away to illustrate the stirrup.

FIG. 11 is a perspective view of the connector illustrated in FIG. 9 showing the shortened stirrup. A timber beam is shown attached to the connector which is embedded in concrete. Portions of the concrete have been removed to show the embedment of the stirrup in the concrete.

DESCRIPTION OF THE INVENTION

Figure 1:
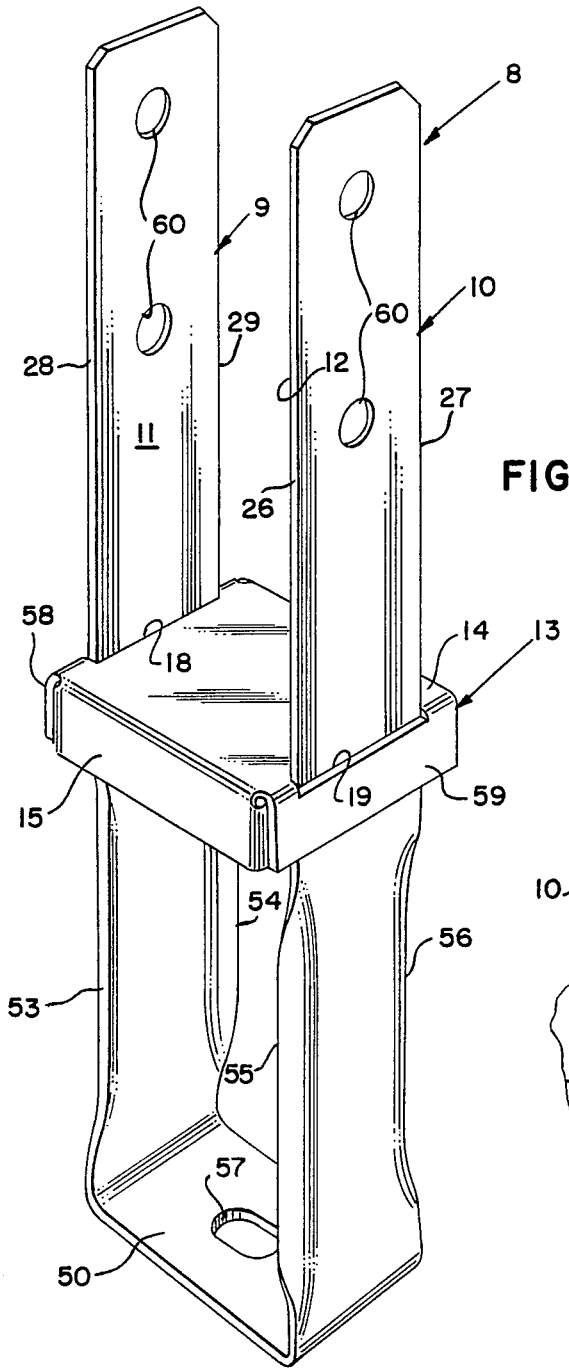
FIG. 1 is a perspective view of one form of the connector of the present invention.

The column base connection of the present invention consists of a foundation support means 1 having a lower support means 2 and an upper planar surface 3, a wood timber member 4 having at least two opposed generally planar sides 5 and 6 and a base 7, and a metal column base connector 8 including: a pair of laterally spaced upstanding stirrup members 9 and 10 having generally planar face members 11 and 12 juxtaposed in planes generally parallel to each other positioned in registration with the generally planar opposed sides 5 and 6 of the wood timber member 4 and extending upwardly from the foundation support means 1, a standoff member 13 having a seat member 14 dimensioned and positioned for receipt of the base 7 of the timber member 4 and a pair of downwardly extending primary leg members 15 and 16 connected to the seat member 14 having a selected length and engaging the upper planar surface 3 of the foundation support means 1 and releasable connection means 17 connected to the standoff member 13 for releasable connection to the stirrup members 9 and 10.

The seat member 14 of the standoff member is preferably formed with a pair of spaced slot openings 18 and 19 juxtaposed in parallel relation adjacent opposite edges 20 and 21 of the seat member 14 each dimensioned for receipt therethrough of the respective stirrup members 9 and 10, each of the stirrup members 9 and 10 are formed with notches 22, 23, 24, and 25 in opposite side edges 26, 27, 28, and 29, and each of the primary leg members 15 and 16 is formed with extensions 30, 31, 32, and 33 at opposite ends 34, 35, 36, and 37 of the primary leg members 15 and 16 and bent at two places 38, 39, 40, 41, 42, 43, 44, and 45 forming a pair of knuckles 46, 47, 48, and 49 dimensioned and disposed to releasably engage the notches 22–25 in the stirrup members 9 and 10.

Figure 2:
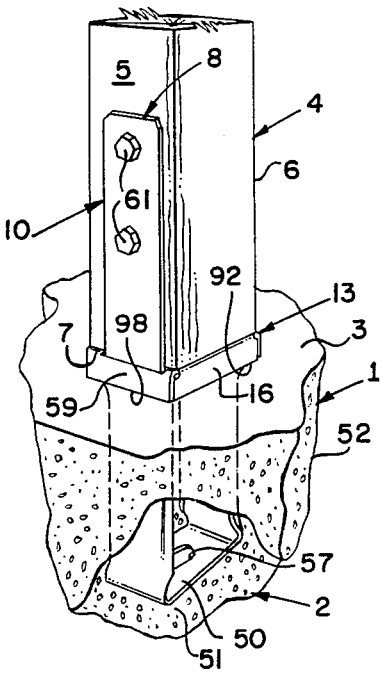
FIG. 2 is a perspective view partially in cross section on a reduced scale showing the connector of FIG. 1 connected to a timber column and embedded in concrete.
Figure 3:
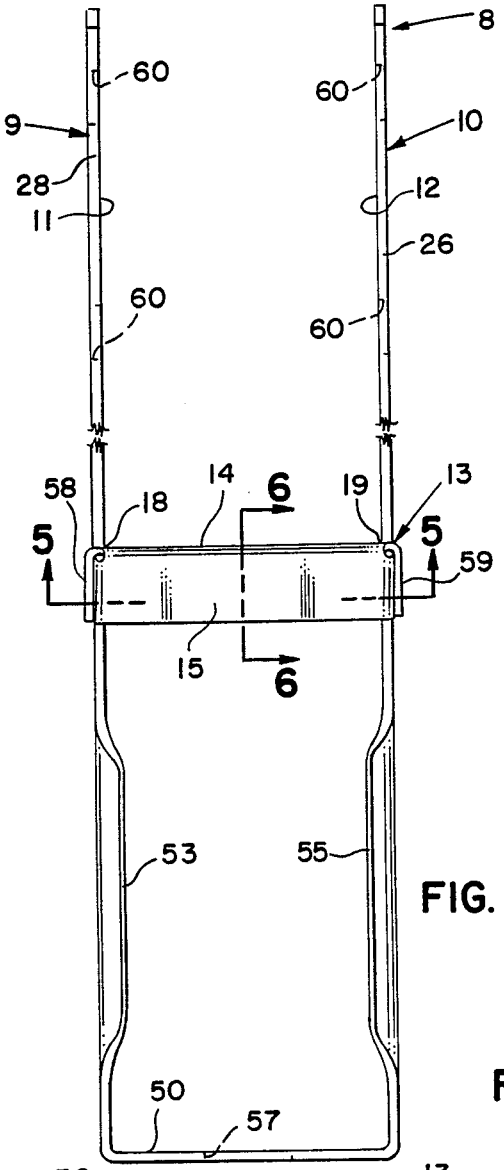
FIG. 3 is a front elevation view of the connector illustrated in FIG. 1 with portions of the stirrups removed for economies in the illustration.
Figure 4:
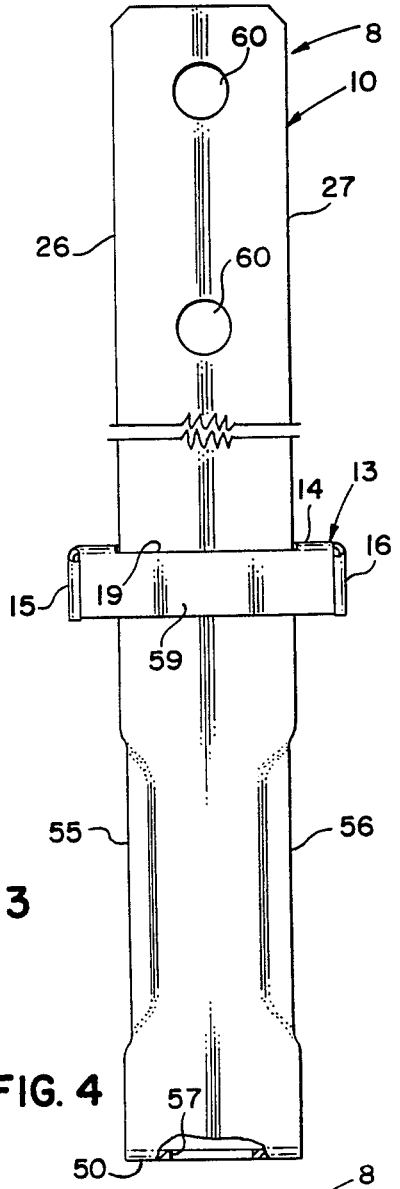
FIG. 4 is a side elevation view of the connector illustrated in FIG. 3 with portions removed for purposes of clarity.
Figure 5:
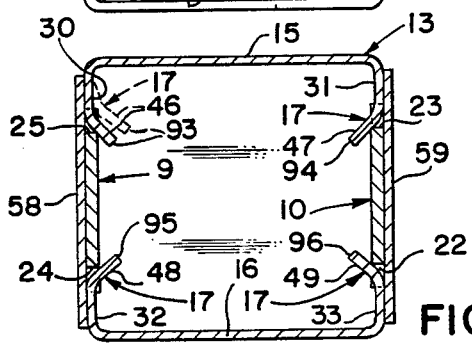
FIG. 5 is a cross sectional view taken along lines 5—5 in FIG. 3. The dashed lines indicate the locked and unlocked positions of the locking tab.

Preferably the stirrup members 9 and 10 are joined by a base member 50 so that the stirrups and base member form a U-shaped member. Primarily, the connector of the present invention is for attachment in concrete, but the connector may also be attached to asphaltic concrete or any other mass which is plastic and then hardens upon setting. The connector may be used by forcing it into wet concrete to the selected elevation, or in many situations, the contractor may choose to either pre-pour a base slab of concrete or anchor the connector and support it with false work, connect the timber to the connector and continue building the structure. At a later date the final finish slab is poured and the connector is anchored in the final slab. In FIG. 2 of the drawings, this second form of installation may be illustrated by a surface 51 which supports the base member 50. The second concrete poured member may then be illustrated by the number 52 which includes the generally planar surface 3 which supports the legs 15 and 16 of the standoff member 13.

Where the pre-pour construction methods above described are used, the building load will bear on the connector. To strengthen the connector the edges of the stirrup members positioned below the standoff member at portions 53, 54, 55, and 56 are bent inwardly to stiffen and strengthen the stirrup members.

The base member 50 joining the stirrup members 9 and 10 is formed with a fastener opening for use with nails or as illustrated in the drawings a bolt hole opening 57 is formed so that the connector may be readily anchored for pre-pour type of construction. Where the connector is installed by forcing it downwardly through wet concrete, the bolt hole 57 permits wet concrete to pass therethrough, thus making it easier to force into the wet concrete.

To withstand the high load forces imposed by the structural timber on the standoff member, the standoff member preferably includes a pair of secondary leg members 58 and 59 which are joined to the standoff seat member 14 and bear upon the upper planar surface 3 of the concrete foundation support means 1.

An advantage of the present connector is that the standoff member automatically registers with the stirrup members at all elevations at which the standoff member is placed. Once the stirrup members have been located, the standoff member is also correctly positioned in the horizontal plane. The key to this form of the column base connection is the provision of a pair of laterally spaced upstanding stirrup members 9 and 10 which may have any cross sectional shape so long as they are positioned in registration with opposite sides of the wood timber member 4 and the standoff member is formed with a pair of spaced openings each dimensioned and configured for receipt therethrough of the respective stirrup members.

Figure 6:
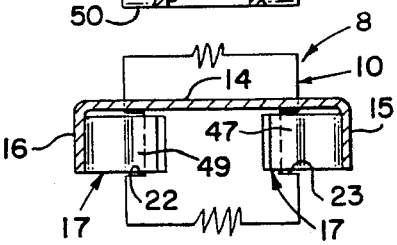
FIG. 6 sectional view of a portion of the standoff member and stirrup member taken along lines 6—6 in FIG. 3.

Still another feature of the present connection is the use of a specialized standoff member which can be formed from a generally square sheet metal blank with a minimum of waste metal and yet result in a structural part which can withstand unusually large columnar loads. Such a standoff member is designed so that it may be used with stirrup members in either a slidably attached manner, a non-attached manner or tack welded to the stirrups. Referring to FIGS. 1–7, the standoff member is formed with a seat member 14 dimensioned and positioned for receipt of the base of the timber member, and a pair of primary leg members 15 and 16 connected to the seat member and having a selected length for bearing upon the upper planar surface 3 of the foundation support means 1. It is to be noted that each of the primary leg members 15 and 16 is formed with extensions 30–33 as previously stated at opposite ends of the primary leg members and are bent at an angle to the respective primary leg members. As shown in FIG. 6, even the extensions 30–33 are placed in compression between the timber 4 and the surface 3 of the concrete once the loads are imposed. Thus all of the metal is performing a structural load holding function.

Preferably the standoff member is designed to interlock with the stirrup members. In one form of the invention, not specifically shown in the drawings, instead of providing a slot in the seat member, the secondary leg members are omitted. In this form of the invention, each of the stirrup members 9 and 10 are formed with notches 22–25 in opposite side edges and each of the primary leg member extensions 30–33 are bent at two places as indicated by numbers 38–45 forming a pair of knuckles 46–49 dimensioned and disposed to releasably engage the notches 22–25 in the stirrup members 9 and 10.

The stirrups may either be formed with bolt holes 60 so that bolts 61 may be used to attach the timber member to the metal connector or formed with nail openings for the receipt of nails therethrough.

FIGS. 9 through 16 illustrate another form of the invention which, as shown in FIGS. 10 and 11 may be either used to support a column 4' or a wood beam member. In describing this form of the invention, different elements are indicated by new numbers and parts identical or similar to previously described parts are indicated by the same number and a prime (') mark. Primarily, this form of the invention is to be inset into wet concrete, but may also be used in pre-pour building systems as previously described.

The standoff post base connection of the present invention consists of a foundation support means 1' having an upper planar surface 3', a wood timber member 4' having at least two opposed generally planar sides 5' and 6' and a base 7', and a metal standoff post base connector 62 including: a pair of laterally spaced upstanding stirrup members 9' and 10' having generally planar face members 11' and 12' juxtaposed in planes generally parallel to each other positioned in registration with the generally planar opposed sides 5' and 6' of the wood timber member 4' and extending upwardly from the foundation support means 1', a standoff member 13' having a seat member 14' dimensioned and positioned for receipt of the base 7' of the timber member 4' and a pair of downwardly extending primary leg members 15' and 16' connected to the seat member 14' having a selected length and engaging the upper planar surface 3' of the foundation support means 1', releasable connection means 17' connected to the standoff member 13' for releasable connection to the stirrup members 9' and 10' , and a V-shaped base member 63 joining the stirrup members 9' and 10'.

The seat member 14' of the standoff member is preferably formed with a pair of spaced slot openings 18' and 19' juxtaposed in parallel relation adjacent opposite edges 20' and 21' of the seat member 14' each dimensioned for receipt therethrough of the respective stirrup members 9' and 10', each of the stirrup members 9' and 10' are formed with notches 22', 23', 24', and 25' in opposite side edges 26', 27', 28', and 29', and each of the primary leg members 15' and 16' is formed with extensions 30', 31', 32', and 33'at opposite ends 34', 35', 36', and 37' of the primary leg members 15' and 16' and bent at two places 38', 39', 40', 41', 42', 43', 44', and 45' forming a pair of knuckles 46', 47', 48', and 49' dimensioned and disposed to releasably engage the notches 22'-25' in the stirrup members 9' and 10'.

To withstand the high load forces imposed by the structural timber on the standoff member, the standoff member preferably includes a pair of secondary leg members 58' and 59' which are joined to the standoff seat member 14' and bear upon the upper planar surface 3' of the concrete foundation support means 1'.

The post base of FIGS. 9-17 has the same advantage of the column base of FIGS. 1-8 in that the standoff member 13' automatically registers with the stirrup members 9' and 10' at all elevations at which the standoff member is placed. Once the stirrup members have been located, the standoff member is also correctly positioned in the horizontal plane. The key to this form of the standoff post base connection is the provision of a pair of laterally spaced upstanding stirrup members 9' and 10' which may have any cross sectional shape so long as they. are positioned in registration with opposite sides of the wood timber member 4' and the standoff member is formed with a pair of spaced openings 18' and 19' each dimensioned and configured for receipt therethrough of the respective stirrup members.

Still another feature of the present connection is the use of a specialized standoff member 13' which can be formed from a generally square sheet metal blank with a minimum of waste metal and yet result in a structural part which can withstand unusually large loads. Such a standoff member is designed so that it may be used with stirrup members 9' and 10' in either a slidably attached manner, a non-attached manner or tack welded to the stirrups. Referring to FIGS. 9-17, the standoff member is formed with a seat member 14' dimensioned and positioned for receipt of the base of the timber member 4', and a pair of primary leg members 15' and 16' connected to the seat member and having a selected length for bearing upon the upper planar surface 3' of the foundation support means 1'. It is to be noted that each of the primary leg members 15' and 16' is formed with extensions 30'-33' as previously stated at opposite ends of the primary leg members and are bent at an angle to the respective primary leg members. Even the extensions 30-33 are placed in compression between the timber 4' and the surface 3' of the concrete once the loads are imposed. Thus all of the metal is performing a structural load holding function.

FIG. 11 illustrates a further form of the invention. This form of the invention is identical to the form of the invention illustrated in FIGS. 9, 10-17 except that the stirrup members 109 and 110 are dimensioned to be shorter than the height of the timber member 64. Stirrup members 109 and 110 are indicated on FIG. 9 with dashed lines indicating the upper ends 65 and 66 of the stirrups. Like parts are given numbers with the addition of the prime (') mark. This form of the invention may be used in various areas of construction; one of which is in patio construction where the wood deck is only a few inches above ground level. This form of construction avoids pouring a ground slab in that post holes may be dug where a connector is to be placed and the hole filled with concrete. Constructing a deck is much easier than pouring a ground slab and in various places may be more architecturally pleasing than a concrete slab.

The V-shaped base member 63 is preferably formed with an opening 57' for easy attachment to a bolt or other anchor in the concrete, or it may simply serve as opening to make it easier to force the connector down into wet concrete. In addition to opening 57', the drawings also show openings 75 in the sides of the base member for the purpose of letting concrete pass therethrough as the connector is pushed down into the wet concrete.

As set forth in the connector previously described, the edges 75, 76, 77, and 78 may be rolled to provide greater columnar strength. This is essential if the prepour type of construction is to be carried out as previously described.

The drawings illustrate the provision of nail or other type fastener openings 80 in the stirrup members for attaching the connector to the wood member. Nails may be used in lieu of or in addition to bolting the timber to the connector. Bolt openings 60' may be punched in the stirrup members and bolts 61' inserted therethrough into the timber member.

In special connectors such as the one shown in FIG. 11, nails 81 may be driven through the nail openings into the timber beam 64.

FIGS. 18-25 illustrate still another form of the invention. In describing this form of the invention, different elements are indicated by new numbers and parts identical or similar to previously described parts are indicated by the same number and a double prime (") mark. This form of the invention is to be inset into wet concrete or used in pre-pour building systems as previously described. The feature to be noted in this form of the invention is the standoff member which is specially designed for carrying very heavy loads such as those imposed by a 6×6 column.

Referring to FIGS. 18-24, the large column base connection consists briefly of a foundation support means similar to the foundation support means illustrated in FIG. 2 and indicated by the number 1, having a lower support means similar to the lower support means indicated by the number 2 and an upper support surface similar to the upper support surface 3; a wood timber member such as timber member 4 except that it may be larger such as a 6×6 having sides and a base; and a large metal column base connector 68 including: a pair of laterally spaced upstanding stirrup members 9" and 10" positioned in registration with the sides of the wood timber member and extending upwardly from the foundation support means and formed with notches 22", 23", 24" and 25" in opposite side edges 26", 27", 28" and 29"; a standoff member 13" having: a seat member 14" dimensioned and positioned for receipt of the base of the timber member; a pair of downwardly extending primary leg members 15" and 16" connected to the seat member 14" having a selected length and which bear upon the upper planar surface of the foundation support means; each of the primary leg members is formed with extensions 30", 31", 32", and 33", at opposite ends 34", 35", 36", and 37" of the primary leg members 15" and 16", and bent at two places along bend lines 38", 39", 40", 41", 42", 43", 44", and 45"forming a pair of knuckles 46", 47", 48", and 49", dimensioned and disposed to releasably engage the notches 22"-25" in the stirrup members 9" and 10"; and a pair of secondary leg members 58" and 59" joined to the standoff seat member 14" and having a selected length for bearing upon the upper supporting surface of the foundation support means, and each secondary leg member is formed with a pair of elongated slot openings 70, 71, 72, and 73 dimensioned for receiving one of the stirrup members therethrough.

It should be noted that the standoff member 13" may be connected to the stirrup members by welding, or it may be used in combination with the stirrup members without being welded thereto or connected in any way. Thus, the standoff member could be merely set upon the concrete foundation between the stirrup members, the column timber member placed upon it and the timber bolted to the stirrup member.

Still another way in which the standoff member 13" of the present invention may be used is to assemble the connector by slipping the stirrup members through openings 70-73 and sliding the standoff member down the stirrups until the legs rest upon the concrete foundation. The timber column is then placed on the seat and bolts placed through bolt openings 60" in the stirrup members into pre-bored openings in the timber. The standoff member need not be restrained vertically as to the stirrups.

Figure 18:
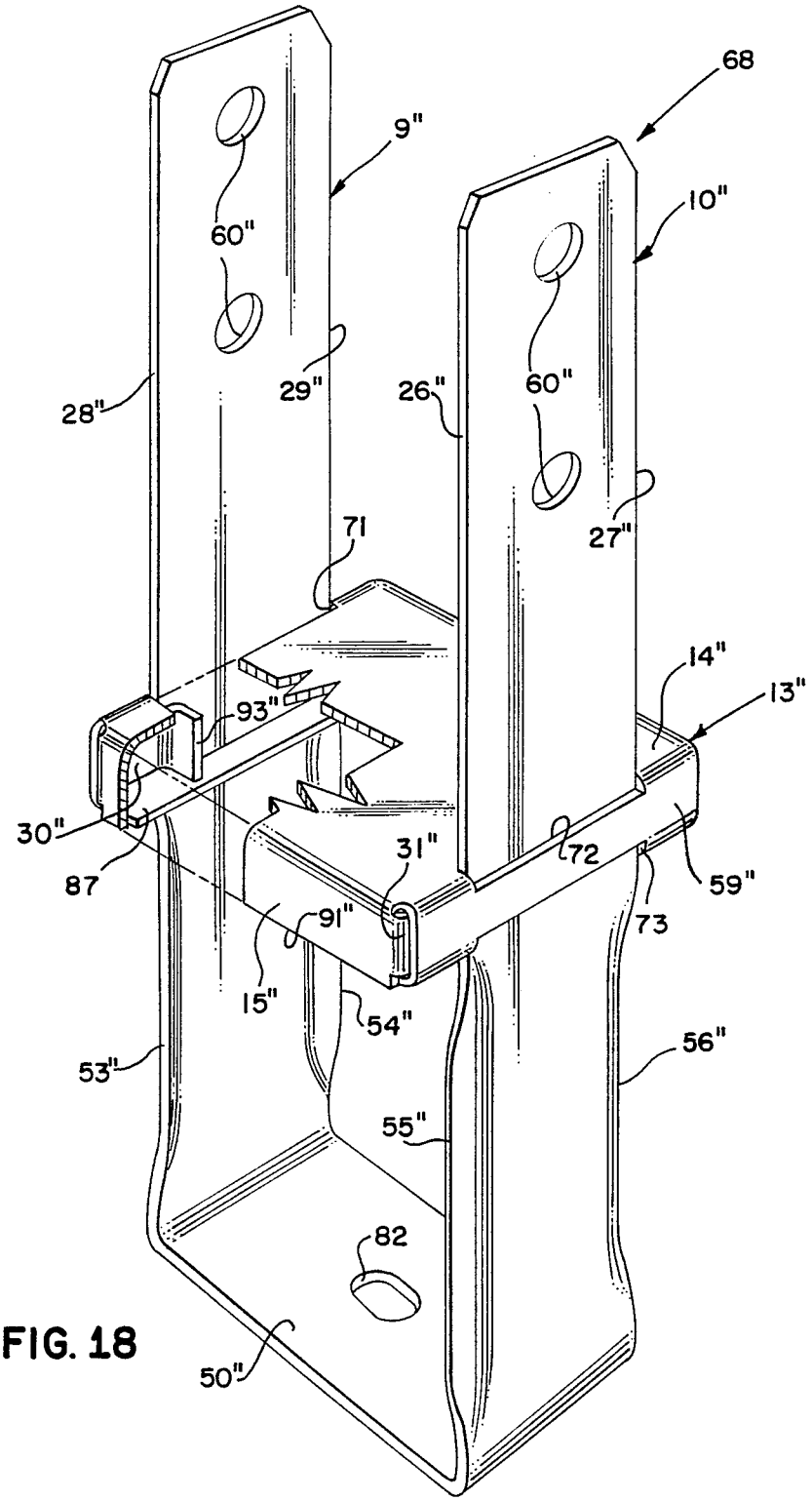
FIG. 18 is a perspective view of still another form of the invention. Portions of the standoff member have been removed for purposes of illustration.
Figure 19:
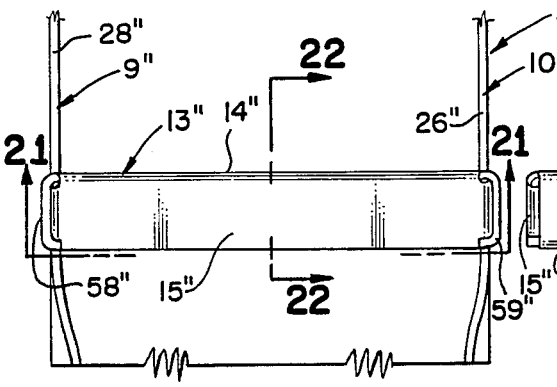
FIG. 19 is a front elevation view of a portion of the connector illustrated in FIG. 18.
Figure 20:
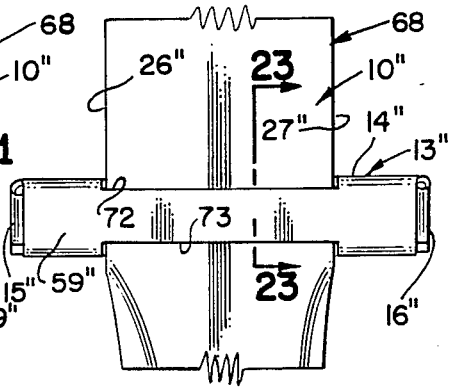
FIG. 20 is a side elevation view of a portion of the connector illustrated FIG. 18.
Figure 21:
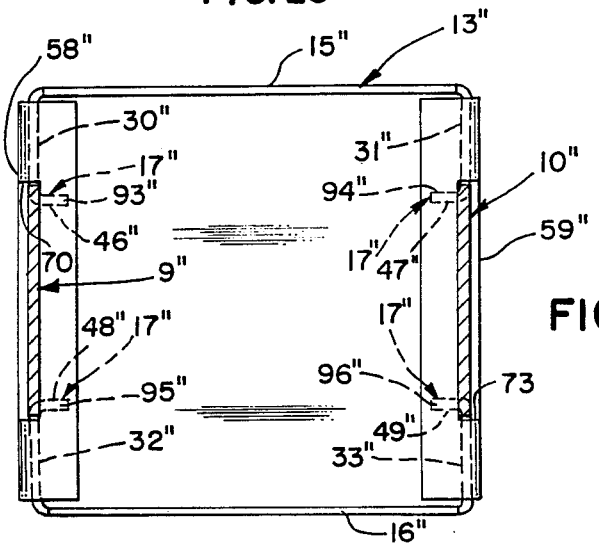
FIG. 21 is a cross sectional view of the connector taken along lines 21—21 of FIG. 19.
Figure 22:
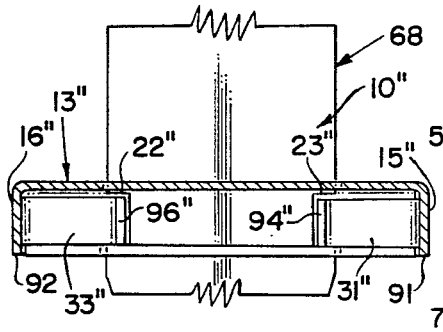
FIG. 22 is a cross sectional view taken along lines 22—22 in FIG. 19.
Figure 23:
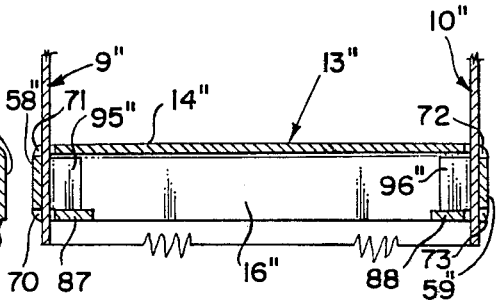
FIG. 23 is a cross sectional view taken along lines 23—23 in FIG. 20.
Figure 25:
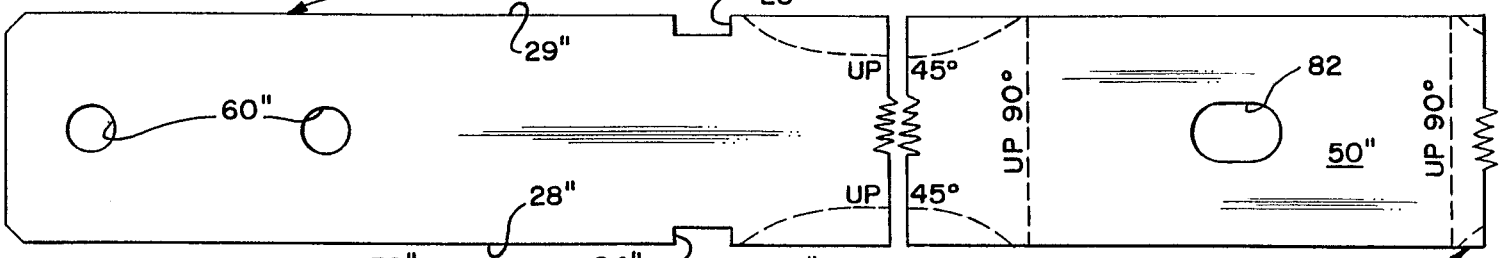
FIG. 25 is a plan view of a portion of the stirrup member illustrated in FIG. 18 with portions removed for economies of illustration.

For use in pre-pour construction, a bolt opening 82 may be placed in the base member 50". To give the connector additional columnar strength, edge portions 53", 54", 55", and 56" may be rolled over as illustrated in FIG. 18.

Preferably, the standoff member is formed with releasable connections means 17" consisting of knuckles 46"-49" which releasably engage notches 22"-25" in the stirrups 9" and 10".

Figure 24:
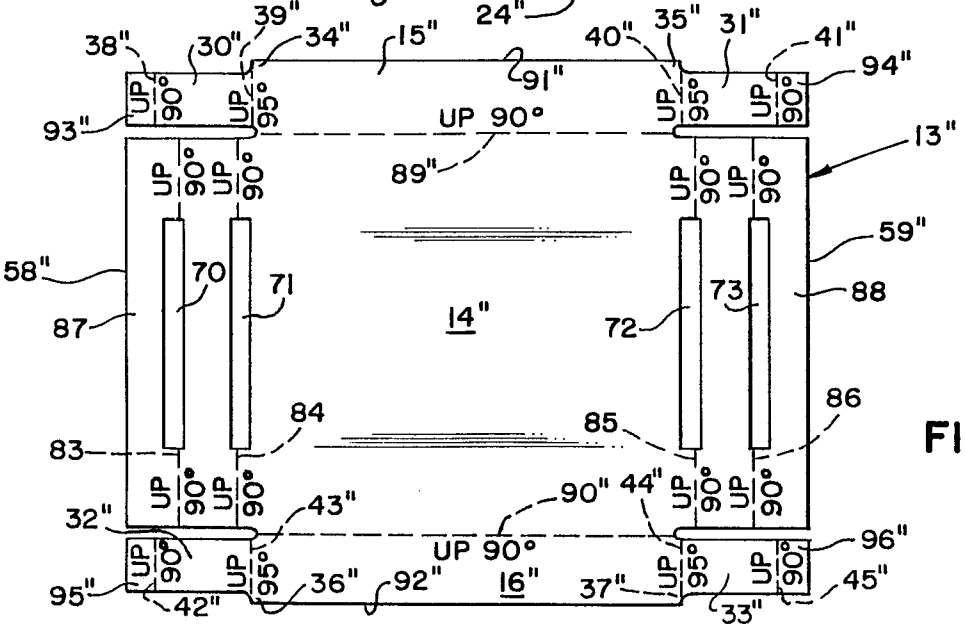
FIG. 24 is a plan view of the standoff member shown in FIG. 8 in blank form prior to bending.

Fabrication of the standoff member 13" is as follows: First, a blank is cut as shown in FIG. 24. The secondary legs 58" and 59" are folded 90° upwardly along bend lines 83, 84, 85, and 86 so that outer portions 87 and 88 of legs 58" and 59" are in a horizontal plane for resting upon the concrete foundation. The primary legs 15" and 16" are bent 90° along bend lines 89" and 90" so that edges 91" and 92" will also rest upon the concrete foundation. Extensions 30"-33" are then bent about 95° along bend lines 39", 40",43", and 44" while outer ends 93", 94", 95", and 96" are bent 90° along bend lines 38", 41", 42", and 45". When desired, knuckles 46"-49" which are formed by bending extensions 30"-33" and outer ends 93"-96" may be locked into notches 22"-25" in the stirrups 9" and 10".

Figures 7, 8:
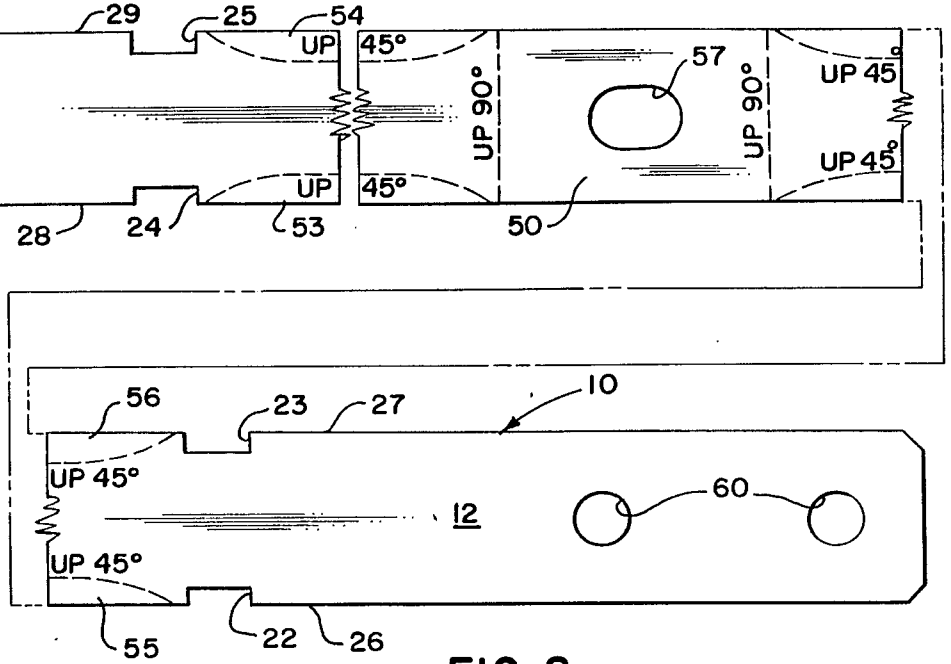
FIG. 7 is a plan view of the standoff member in blank form prior to bending.
FIG. 8 is a plan view of the stirrup member in blank form prior to bending. Because of the length of the stirrup, the stirrup has been cut and a portion moved to a juxtaposed position.
Figure 9:
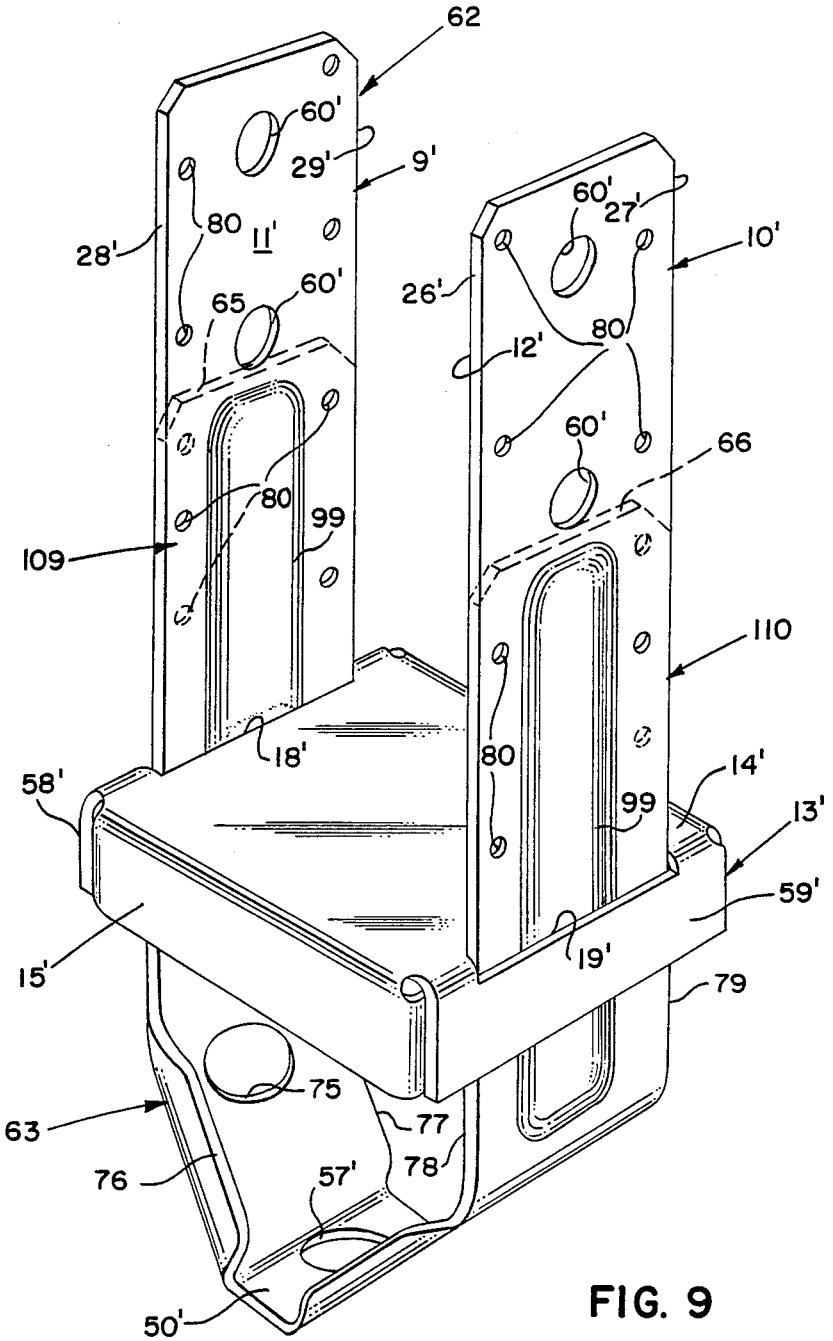
FIG. 9 is a perspective view of another form of the invention. The dashed lines indicate the height of the stirrup members when used for supporting beams in ground level deck construction.
Figure 12:
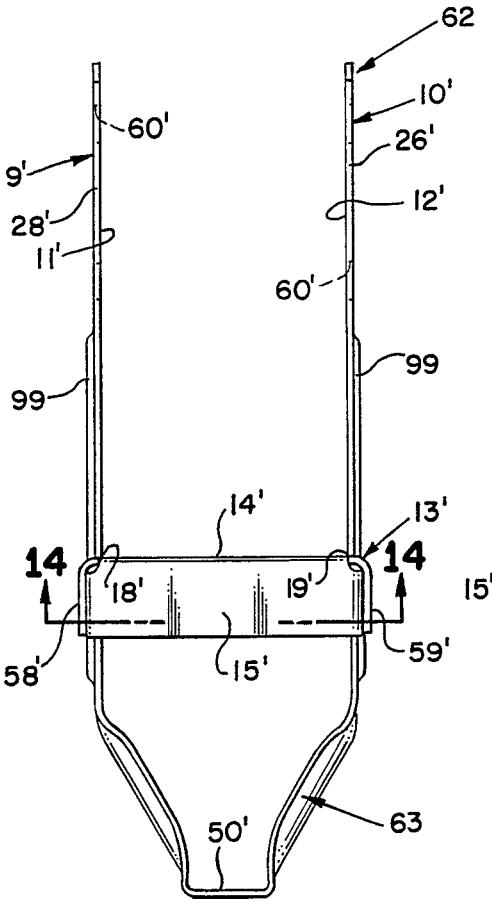
FIG. 12 is a front elevation view of the connector illustrated in FIG. 9.
Figure 13:
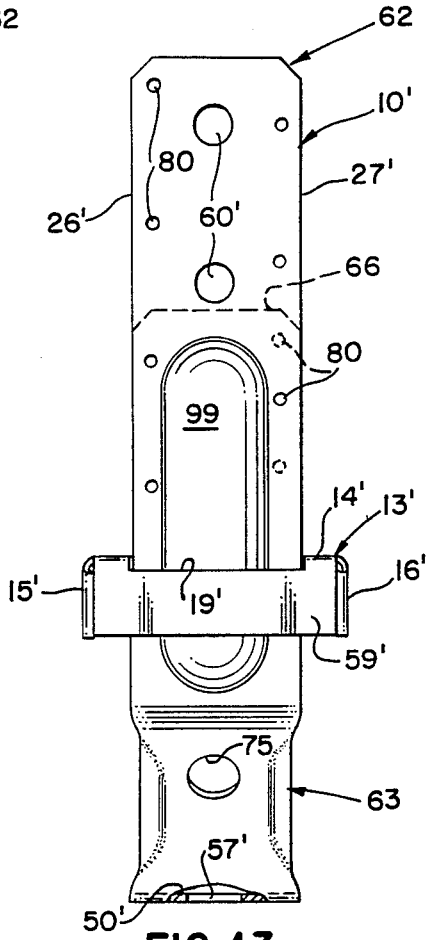
FIG. 13 is a side elevation view of the connector illustrated in FIG. 12 with portions removed for illustration purposes.
Figure 14:
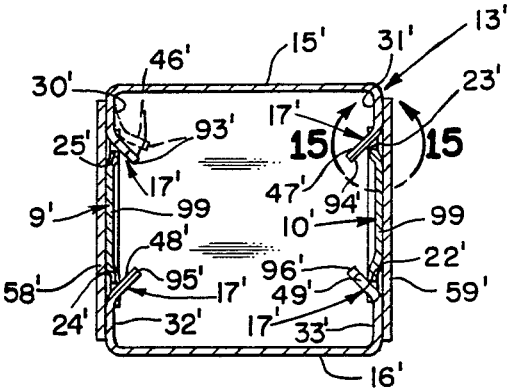
FIG. 14 is a cross sectional view of the standoff member and stirrups taken along lines 14—14 in FIG. 12.
Figure 15:
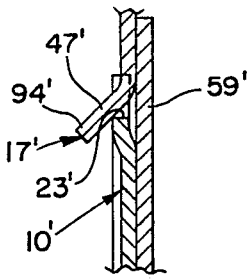
FIG. 15 is a cross section of a portion of the connector taken generally along lines 15—15 of FIG. 14.
Figure 17:
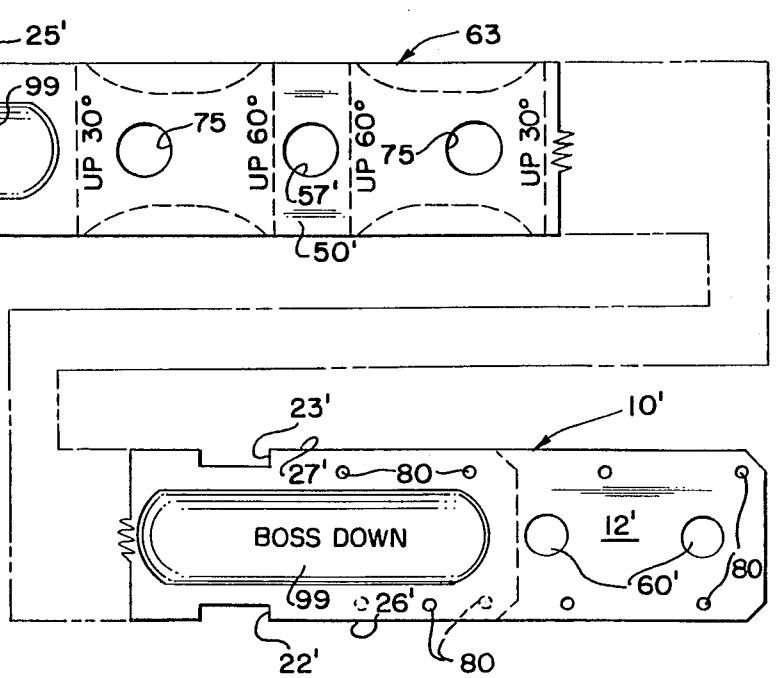
FIG. 17 is a plan view of the stirrup member illustrated in FIG. 9 in the blank form prior to bending. The stirrup has been cut and removed to a juxtaposed position for economies of illustration.
Figure 16:
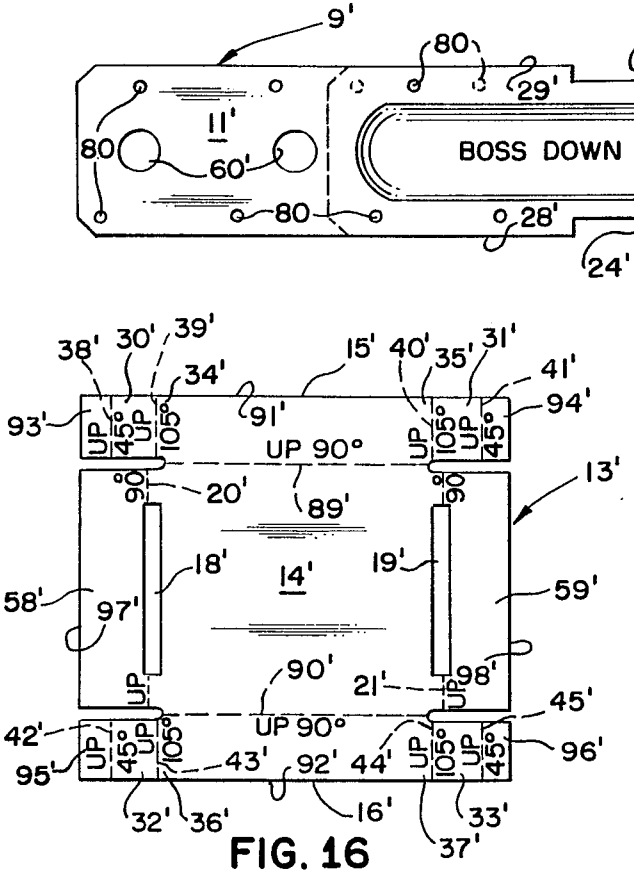
FIG. 16 is a plan view of the standoff member illustrated in FIG. 9 in blank form prior to bending.

Fabrication of the standoff member 13 in FIGS. 1-16 is similar to the fabrication of standoff member 13" illustrated in FIGS. 18-24 and is as follows: First, a blank is cut as shown in FIG. 7. The secondary legs 58 and 59 are folded 90° upwardly along bend lines 20 and 21 so that the edges 97 and 98 of the legs rest upon the concrete foundation. The primary legs 15 and 16 are bent 90° along bend lines 89 and 90 so that edges 91 and 92 will also rest upon the concrete foundation. Extensions 30-33 are then bent about 105° along bend lines 39, 40, 43, and 44 while outer ends 93, 94, 95, and 96 are bent 45° along bend lines 38, 41, 42, and 45. When desired, knuckles 46-49 which are formed by bending extensions 30-33 and outer ends 93-96 may be locked into notches 22-25 in the stirrups 9 and 10.

Fabrication of the standoff member 13' illustrated in FIGS. 9-17 is identical to the standoff member 13 described above. For purposes of a complete description, the construction of the standoff member 13' is repeated, but with the insertion of the numbering system applicable.

The secondary legs 58' and 59' are folded 90° upwardly along bend lines 20' and 21' so that the edges 97' and 98' of the legs rest upon the concrete foundation. The primary legs 15' and 16' are bent 90° along bend lines 89' and 90' so that edges 91' and 92' will also rest upon the concrete foundation. Extensions 30'-33' are then bent about 105° along bend lines 39', 40', 43', and 44' while outer ends 93', 94', 95', and 96' are bent 45° along bend lines 38', 41', 42', and 45'. When desired, knuckles 46'-49' which are formed by bending extensions 30'-33' and outer ends 93'-96' may be locked into notches 22'-25' in the stirrups 9' and 10'.

To strengthen and rigidify the stirrup members, embossments may be stamped therein. The illustrations show embossments 99' in FIGS. 9, 10, 11, 12, 13, and 17.

The standoff members in this application may be of various heights, but at the present time, the code requires only a 1' standoff of the timber above the concrete and this is the standard height. Preferably the connector is constructed without welding but as previously stated, this application covers welded connectors also. For column and post bases for 4×4, 4×6 and 6×6 timbers, 12 gauge galvanized steel is recommended, and for the stirrup members, 10 gauge galvanized steel is recommended.

Dimensions will vary for different size connectors, but as an example, a connector for a nominal post size 4×4 has a distance between stirrups of 3 9/16", a seat width of 3½", an embedded stirrup length of 7⅛", a stirrup width of 2¼" and the distance of the lower bolt hole 60 above the seat member 14 of 4 5/16". Fasteners may be ⅝' machine bolts or nailing as required. Allowable loads by code are approximately 5,335 pounds in uplift and compression loads of 6,165 pounds.

For the standoff post base illustrated in FIGS. 9-17, again, the standoff member should raise the post at least 1" above the concrete. For a nominal post size of 4×4, the width of the standoff member should be 3½", the stirrup member below the standoff member should be 3½", the distance between the stirrups may be 3 9/16" and the distance of the center of the lowermost bolt hole 60′ should be 3 7/16″ above the seat 14′ of the standoff member. Spacing between bolt openings 60′ should be 2″. The standoff member may be constructed from 12 gauge galvanized steel and the stirrup members from 14 gauge galvanized steel. Allowable code loads are 2,400 pounds for uplift and 4,165 pounds for compression loads.

For the standoff post base illustrated in FIGS. 18–23, for holding a 6×6 timber the width between stirrups may be 5½″, the width of the seat member 5 7/16, the stirrup may be inserted into the concrete a distance of 6⅞″, the width of the stirrup 3″, and the distance of the lower bolt hole 60″ above the seat member should be 4½. Allowable code loads for this connector are 7,665 pounds uplift and 11,665 pounds in compression. The standoff member may be 12 gauge galvanized and the stirrup member 10 gauge galvanized. Fasteners should be ⅝″ machine bolts.

We claim:

1. A column base connection comprising:
   a. foundation support means having a lower support means and an upper support surface;
   b. a wood timber member having sides and a base;
   c. a metal column base connector including:
      1. a pair of laterally spaced upstanding stirrup members each formed with interconnection means positioned in registration with said sides of said wood timber member and extending upwardly from said foundation support means;
      2. a standoff member having a seat member formed with a pair of spaced slot openings positioned adjacent opposite edges of said seat member each dimensioned for receipt therethrough of said respective stirrup members, and said seat is dimensioned and positioned for receipt of said base of said timber member and a pair of downwardly extending primary leg members connected to said seat member having a selected length and which bear upon said upper support surface of said foundation support means; and
      3. each of said primary leg members is formed with releasable connection means preventing relative vertical movement between said standoff member and said stirrup members and formed for releasable connection to said interconnection means formed in said stirrup members; and
   d. fastener means attaching said stirrup members to said wood timber member.

2. A column base connection as described in claim 1 comprising:
   a. said interconnection means consists of each of said stirrup members being formed with notches in opposite side edges; and
   b. each of said primary leg members is formed with extensions at opposite ends of said primary leg members and bent at two places forming a pair of knuckles dimensioned and disposed to releasably engage said notches in said stirrup members.

3. A column base connection as described in claim 2 comprising:
   a. said stirrup members are joined by a base member;
   b. said foundation support means is a concrete member having a surface supporting said base member of said stirrup members; and
   c. said foundation support means also includes a second concrete poured member including an upper surface supporting said legs of said standoff member.

4. A column base connection as described in claim 3 comprising:
   a. portions of said edges of said stirrup members positioned below said standoff member are bent inwardly to stiffen and strengthen said stirrup members;
   b. said base member joining said stirrup members is formed with a fastener opening;
   c. said standoff member includes a pair of secondary leg members joined to said standoff seat member and which bear upon said upper support surface of said concrete foundation support means; and
   d. fastener means attaching said stirrup members to said wood timber member.

5. A column base connection comprising:
   a. foundation support means having a lower support means and an upper support surface;
   b. a wood timber member having generally planar sides and a base;
   c. a metal column base connector including:
      1. a pair of laterally spaced upstanding stirrup members each formed with interconnection means positioned in registration with opposite sides of said wood timber member and extending upwardly from said foundation support means;
      2. a standoff member having a seat member dimensioned and positioned for receipt of said base of said timber member and said seat members is formed with a pair of spaced slot openings each dimensioned for receipt therethrough of said respective stirrup members and a pair of primary leg members connected to said seat member having a selected length and which bear upon said upper support surface of said foundation support means;
      3. each of said primary leg members is formed with connection means preventing relative vertical movement between said standoff member and said stirrup members and formed for connection to said interconnection means formed in said stirrup members; and
   d. fastener means attaching said stirrup members to said wood timber member.

6. A column base connection comprising:
   a. foundation support means having a lower support means and an upper support surface;
   b. a wood timber member having sides and a base;
   c. a metal column base connector including:
      1. a pair of laterally spaced upstanding stirrup members positioned in registration with opposite sides of said wood timber member and extending upwardly from said foundation support means;
      2. a standoff member positioned between said stirrup members having a seat member dimensioned and positioned for receipt of said base of said timber member and said seat member is formed with a pair of spaced slot openings each dimensioned for receipt therethrough of said respective stirrup members, and a pair of primary leg members connected to said seat member having a selected length and which bear upon said upper support surface of said foundation support means; and
      3. each of said primary leg members is formed with extensions at opposite ends of said primary leg members bent at an angle to said respective primary leg members; and d. fastener means attaching said stirrup members to said wood timber member.

7. A column base connection comprising:

a. foundation support means having a lower support means and an upper support surface;

b. a wood timber member having sides and a base;

c. a metal column base connector including:

1. a pair of laterally spaced upstanding stirrup members positioned in registration with opposite sides of said wood timber member and extending upwardly from said foundation support means;

2. a standoff member positioned between said stirrup members having a seat member dimensioned and positioned for receipt of said base of said timber member, and a pair of primary leg members connected to said seat member having a selected length and which bear upon said upper support surface of said foundation support means; and 3. each of said primary leg members is formed with extensions at opposite ends of said primary leg members bent at an angle to said respective primary leg members;

d. fastener means attaching said stirrup members to said wood timber member;

e. each of said stirrup members are formed with notches in opposite side edges; and f. each of said primary leg member extensions are bent at two places forming a pair of knuckles dimensioned and disposed to releasably engage said notches in said stirrup members.

8. A standoff post base connection comprising:

a. foundation support means having a lower support means and an upper support surface;

b. a wood timber member having sides and a base;

c. a metal standoff post base connector including:

1. a pair of laterally spaced upstanding stirrup members each formed with interconnection means having generally planar face members positioned in planes generally parallel to each other positioned in registration with said generally planar opposed sides of said wood timber member and extending upwardly from said foundation support means;

2. a standoff member having a seat member formed with a pair of spaced slot openings positioned adjacent opposite edges of said seat member, each dimensioned for receipt therethrough of said respective stirrup members, and said seat is dimensioned and positioned for receipt of said base of said timber member and a pair of downwardly extending primary leg members connected to said seat member having a selected length and which bear upon said upper support surface of said foundation support means;

3. each of said primary leg members is formed with releasable connection means for releasable connection to said interconnection means formed in said stirrup members; and 4. said stirrup members are joined by a V-shaped base member; and d. fastener means attaching said stirrup members to said wood timber member.

9. A standoff post base connection comprising:

a. foundation support means having a lower support means and an upper support surface;

b. a wood timber member having sides and a base;

c. a metal standoff post base connector including:

1. a pair of laterally spaced upstanding stirrup members having generally planar face members juxtaposed in planes generally parallel to each other positioned in registration with said generally planar opposed sides of said wood timber member and extending upwardly from said foundation support means;

2. a standoff member having a seat member dimensioned and positioned for receipt of said base of said timber member and a pair of downwardly extending primary leg members connected to said seat member having a selected length and which bear upon said upper support surface of said foundation support means;

3. releasable connection means connected to said standoff member for releasable connection to said stirrup members;

d. fastener means attaching said stirrup members to said wood timber member;

e. said seat member of said standoff member is formed with a pair of spaced slot members juxtaposed in parallel relation adjacent opposite edges of said seat member each dimensioned for receipt therethrough of said respective stirrup members;

f. each of said stirrup members are formed with notches in opposite side edges;

g. each of said primary leg members is formed with extensions at opposite ends of said leg members and bent at two places forming a pair of knuckles dimensioned and disposed to releasably engage said notches in said stirrup members; and h. said stirrup members are joined by a V-shaped base member.

10. A standoff post base connection comprising:

a. foundation support means having a lower support means and an upper support surface;

b. a wood timber member having generally planar sides and a base;

c. a metal standoff post base connector including:

1. a pair of laterally spaced upstanding stirrup members each formed with interconnection means positioned in registration with opposite sides of said wood timber member and extending upwardly from said foundation support means;

2. a standoff member having a seat member dimensioned and positioned for receipt of said base of said timber member and said seat member is formed with a pair of spaced slot openings each dimensioned for receipt therethrough of said respective stirrup members and a pair of primary leg members connected to said seat member having a selected length and which bear upon said upper support surface of said foundation support means;

3. said stirrup members are joined by a V-shaped base member located below said standoff member;

4. each of said primary leg members is formed with connection means preventing relative vertical movement between said standoff members and said stirrup members and formed for connection to said interconnection means formed in said stirrup members; and d. fastener means attaching said stirrup members to said wood timber member.

11. A standoff post base connection comprising:

a. foundation support means having a lower support means and an upper support surface;

b. a wood timber member having sides and a base;
c. a metal standoff post base connector including:
1. a pair of laterally spaced upstanding stirrup members positioned in registration with opposite sides of said wood timber member and extending upwardly from said foundation support means;
2. a standoff member having a seat member dimensioned and positioned for receipt of said base of said timber member and said seat member is formed with a pair of spaced slot openings, each dimensioned for receipt therethrough of said respective stirrup members, and a pair of primary leg members connected to said seat member having a selected length and which bear upon said upper surface of said foundation support means;
3. each of said primary leg members is formed with extensions at opposite ends of said primary leg members bent at an angle to said respective primary leg members; and
4. said stirrup members are joined by a V-shaped base member located below said standoff member; and
d. fastener means attaching said stirrup members to said wood timber member.

12. A beam connection comprising:
a. foundation support means having a lower support means and an upper bearing surface;
b. a wood timber beam member having a selected height and having sides and a bottom edge;
c. a metal beam connector including:
1. a pair of laterally spaced upstanding stirrup members each formed with interconnection means positioned in registration with said sides of said wood timber member and extending upwardly from said foundation support means;
2. a standoff member having a seat member formed with a pair of spaced slot openings positioned adjacent opposite edges of said seat member, each dimensioned for receipt therethrough of said respective stirrup members, and said seat is dimensioned and positioned for receipt of said bottom edge of said timber member and a pair of downwardly extending primary leg members connected to said seat member having a selected length and which bear upon said upper bearing surface of said foundation support means;
3. each of said primary leg members is formed with releasable connection means for releasable connection to said interconnection means formed in said stirrup members; and
4. said length of said stirrup members located above said seat member of said standoff member is less than said selected height of said timber member; and
d. fastener means attaching said stirrup members to said wood timber member.

13. A large column base connection comprising:
a. foundation support means having a lower support means and an upper support surface;
b. a wood timber member having sides and a base;
c. a large metal column base connector including:
1. a pair of laterally spaced upstanding stirrup members positioned in registration with said sides of said wood timber member and extending upwardly from said foundation support means and formed with notches in opposite side edges;
2. a standoff member having:
(a) a seat member dimensioned and positioned for receipt of said base of said timber member;
(b) a pair of downwardly extending primary leg members connected to said seat member having a selected length and which bear upon said upper planar surface of said foundation support means;
(c) each of said primary leg members is formed with extensions at opposite ends of said primary leg members and bent at two places forming a pair of knuckles dimensioned and disposed to releasably engage said notches in said stirrup members; and
(d) a pair of secondary leg members joined to said standoff seat member and having a selected length for bearing upon said upper supporting surface of said foundation support means, and each secondary leg member is formed with a pair of elongated slot openings dimensioned for receiving one of said stirrup members therethrough; and
d. fastener means attaching said stirrup members to said wood timber member.

14. A large metal column base connection comprising:
a. foundation support means having a lower support means and an upper support surface;
b. a wood timber member having sides and a base;
c. a metal column base connector including:
1. a pair of laterally spaced upstanding stirrup members positioned in registration with said sides of said wood timber member and extending upwardly from said foundation support means;
2. a standoff member having:
(a) a seat member dimensioned and positioned for receipt of said base of said timber member;
(b) a pair of downwardly extending primary leg members connected to said seat member having a selected length and which bear upon said upper support surface of said foundation support means;
(c) each of said primary leg members is formed with extensions at opposite ends of said primary leg members, and having lower edges and bent at two places forming a pair of knuckles; and
(d) a pair of secondary leg members joined to said standoff seat member and having a selected length for bearing upon said upper support surface of said foundation support means and extending beneath and engaging said lower edges of said extension members of said primary members; and
d. fastener means attaching said stirrup members to said wood timber member.

15. A large metal column base connection comprising:
a. foundation support means having a lower support means and an upper support surface;
b. a wood timber member having sides and a base;
c. a metal column base connector including:
1. a pair of laterally spaced upstanding stirrup members positioned in registration with opposite sides of said wood timber member and extending upwardly from said foundation support means;
2. a standoff member having:
(a) a seat member dimensioned and positioned for receipt of said base of said timber member;

(b) a pair of downwardly extending primary leg members connected to said seat member having a selected length and which bear upon said upper support surface of said foundation support means;

(c) each of said primary leg members is formed with extensions at opposite ends of said primary leg members and bent at two places forming a pair of knuckles; and (d) a pair of secondary leg members joined to said standoff seat member and having a selected length for bearing upon said upper support surface of said foundation support means, and each secondary leg member is formed with a pair of elongated slot members dimensioned for receiving one of said stirrup members therethrough; and d. fastener means attaching said stirrup members to said wood timber member.

* * * * *